United States Patent [19]

Royzman

[11] Patent Number: 4,664,701

[45] Date of Patent: May 12, 1987

[54] METHOD AND PLANT FOR FULLY CONTINUOUS PRODUCTION OF STEEL STRIP FROM ORE

[75] Inventor: Semyon E. Royzman, Mt. Lebanon Township, Allegheny County, Pa.

[73] Assignee: Blaw Knox Corporation, Pittsburgh, Pa.

[21] Appl. No.: 819,501

[22] Filed: Jan. 15, 1986

[51] Int. Cl.[4] ..... C21C 7/00

[52] U.S. Cl. ..... 75/51.1; 75/46; 75/49

[58] Field of Search ..... 75/46, 49, 51.1

[56] References Cited

U.S. PATENT DOCUMENTS

| | | | |
|---|---|---|---|
| 4,419,128 | 12/1983 | Nakagawa | 75/46 |
| 4,456,476 | 6/1984 | Sherwood | 75/46 |
| 4,457,777 | 7/1984 | MacGregor | 75/46 |
| 4,541,865 | 9/1985 | Sherwood | 75/46 |

OTHER PUBLICATIONS

Nakagawa, Ryuichi et al., "Construction and Operation of a New Continuous Steelmaking Facility" from *Iron and Steel Engineer,* Jun., 1984, pp. 57–64.

*Primary Examiner*—Peter D. Rosenberg

*Attorney, Agent, or Firm*—Buell, Ziesenheim, Beck & Alstadt

[57] ABSTRACT

The specification discloses fully continuous production of steel strip from ore. Ore is continuously charged in particulate form to a reactor where it is adhered to hot metal in a continuous flash smelting process. The hot metal is continuously refined, is continuously clarified by bubbling an inert gas through it, is continuously alloyed, and is then continuously degassed. The degassed metal is then continuously cast and continuously rolled to steel strip.

6 Claims, 4 Drawing Figures

METHOD AND PLANT FOR FULLY CONTINUOUS PRODUCTION OF STEEL STRIP FROM ORE

This invention relates to a fully continuous process by which iron ore is reduced to liquid iron, the iron is converted into steel, the steel is refined, and the refined steel is cast and rolled into steel strip as a single process.

The manufacture of steel strip has traditionally resulted from a series of discrete steps, each carried out independently of others. In traditional plants, iron ore has been reduced in a blast furnace to molten iron with impurities, notably carbon, sulfur and phosphorous. Such impure iron is commonly referred to as "pig iron." The hot pig iron is then transferred, in a ladle, for example, to another furnace where it is converted to steel of a desired grade. Scrap may be melted with the hot metal, or it may be separately melted. The process of reducing pig iron to steel has been carried out in a wide variety of furnaces, including Bessemer converters, open hearth furnaces, basic oxygen furnaces, and electric furnaces. After refining of the steel, the traditional practice has been to tap the furnace and to pour the metal into a cast iron ingot mold in which the hot steel freezes to form an ingot. Another known practice is to cast an ingot continuously and then cut it into slabs of a required length. In either case, the ingot is reheated in a soaking pit or a reheating furnace prior to hot rolling which is commonly followed by cold rolling. In some cases direct rolling of slabs into strip takes place. Also, in recent years, proposals have been put forward for continuous casting of steel strip from hot steel upon discharge from a furnace.

Existing methods of steel strip production have a common major problem—they are all periodical at least in the liquid metal processing areas, i.e., they all work on a batch basis. That is coke, limestone and iron ore are charged to a blast furnace in layers. The blast furnace is tapped at intervals after which the hot blast and melting in the furnace is resumed. Hot metal is transferred from the blast furnace to a reduction furnace where it is reduced to steel in a batch process. The tapping of the steelmaking furnace produces another batch which must be poured into ingot molds or maintained hot while the process of continuous casting takes place.

I provide a method and plant for fully continuous production of high quality steel strip from ore in a single process. I directly reduce iron ore concentrate to pig iron on a continuous basis, continuously adding raw materials to the furnace and continuously extracting hot metal therefrom. I prefer to add ore in particulate form and to continuously charge coal, oxygen, and limestone to reduce and flux the ore. I continuously transfer the hot metal to a refining zone in which pig iron is reduced to steel of desired quality. I preferably carry out refining continuously in two areas with a multi-zone refining unit in each area. I further prefer to refine the metal in a vacuum degasser. In a first zone of the multi-zone refining unit, I prefer to direct hot metal downwardly in a stream above a hearth while continuously injecting oxygen and limestone into the stream. I prefer to move the liquid from the hearth in a shallow stream while bubbling an inert gas through the metal stream in a clarifying second zone. I further prefer to settle the metal in a bath in a settling third zone and additionally to refine the metal by addition of alloying and fluxing agents to metal in the settling zone. I may employ a second multi-zone refining unit and carry out some or all of the fluxing and/or alloying steps in that unit. After refining and alloying of the steel, I preferably pass the metal continuously through a vacuum degassing area to a casting area. I prefer to introduce the refined metal into a casting area wherein hot metal is continually added to the casting area and is continually withdrawn from the casting area as hot strip. The hot strip is then continuously rolled to forge the metal into high quality steel of known composition, structure and dimensions and continuously coiled.

Other details, objects and advantages of my invention will become more apparent as the following description of a present preferred embodiment thereof proceeds.

In the accompanying drawings, I have illustrated a present preferred embodiment of my invention in which FIG. 1 is a schematic representation of a plant used to carry out my invention, taken partially in section;

Figure 1:
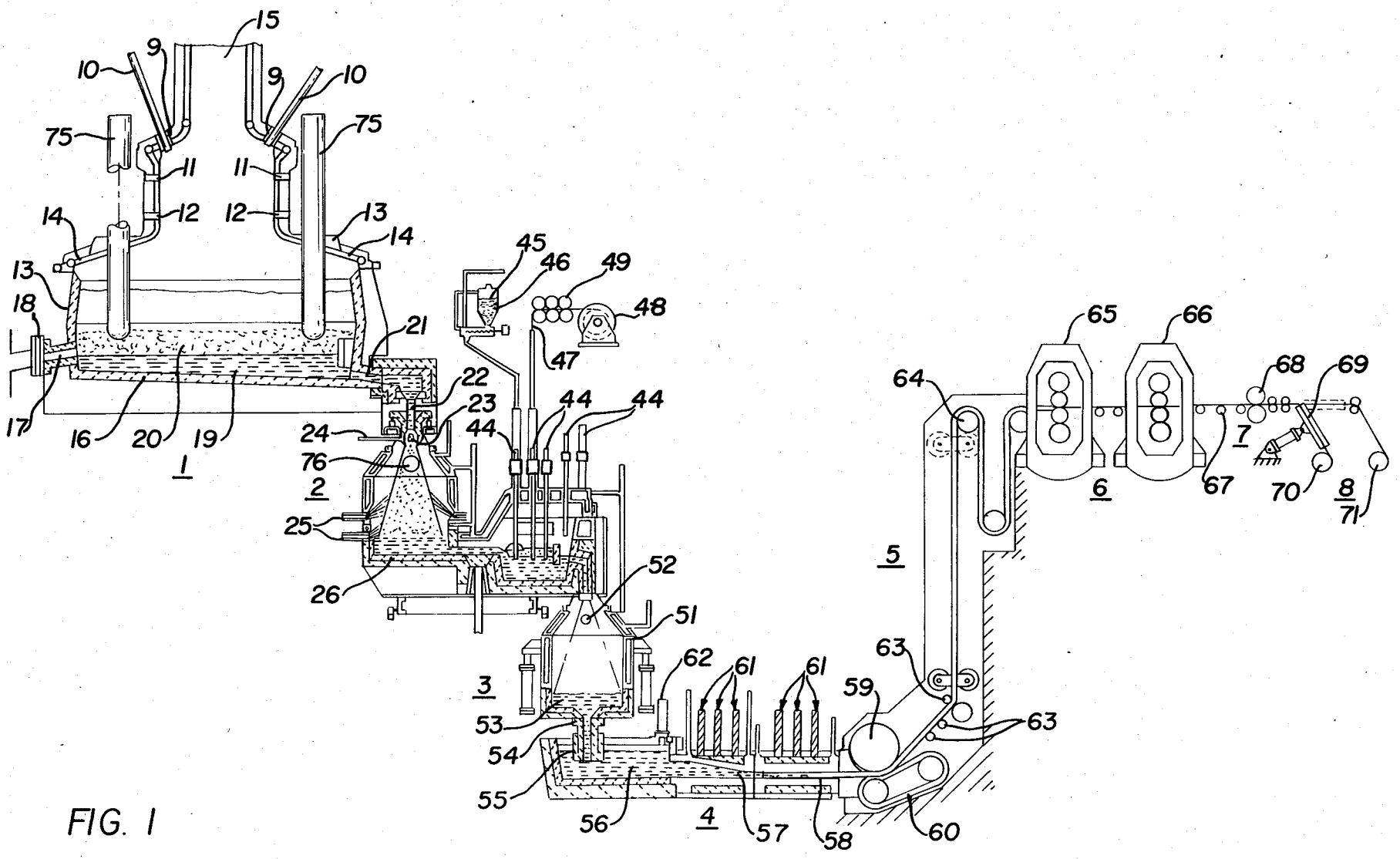
Figure 2:
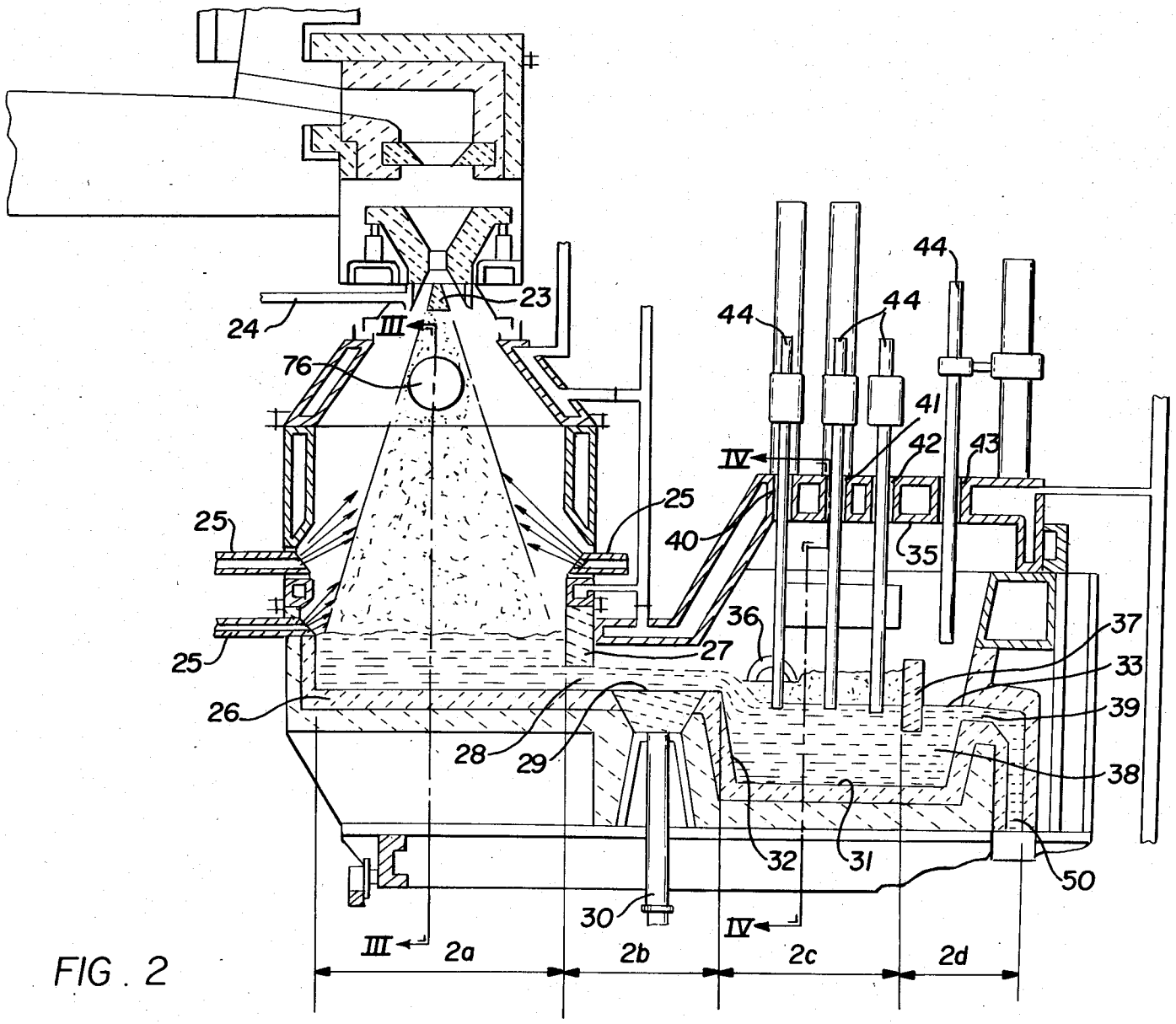
FIG. 2 is a side sectional view of a multi-zone refiner incorporated within the plant shown in FIG. 1.
Figure 4:
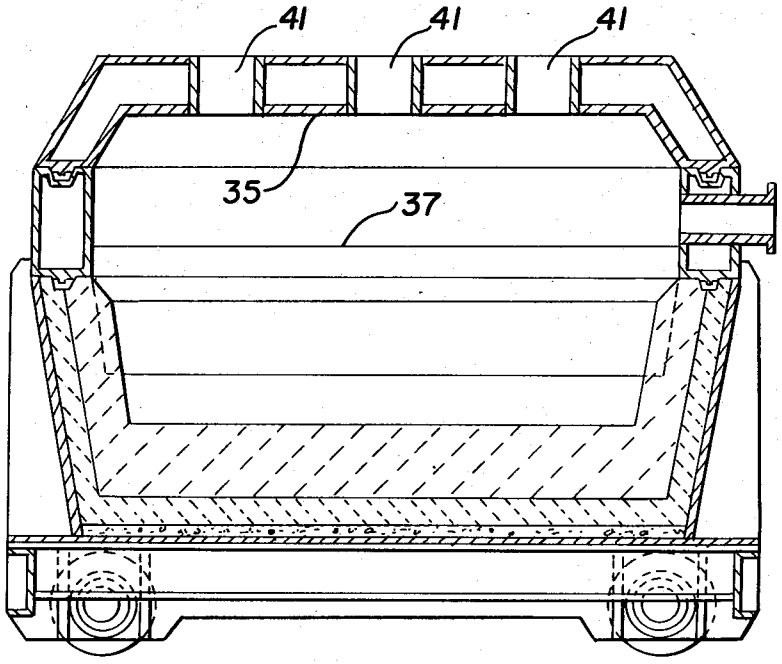
FIG. 4 is a sectional view taken on line IV—IV of FIG. 2.
Figure 3:
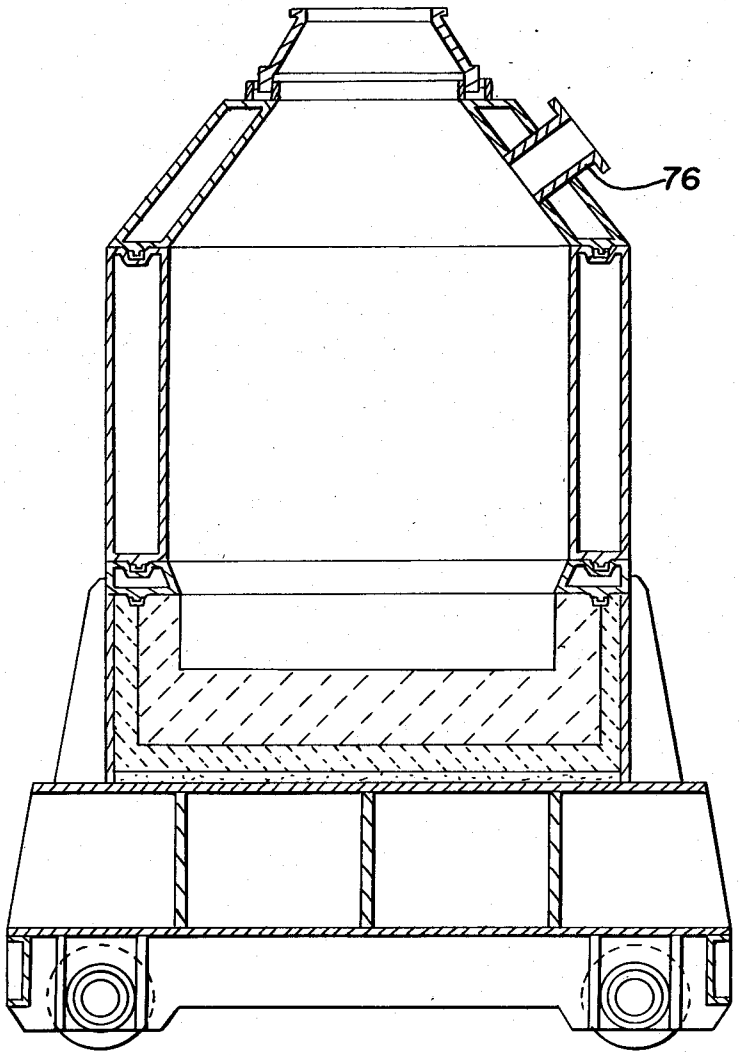
FIG. 3 is a sectional view taken on line III—III of FIG. 2.

My fully continuous steel strip making plant comprises a reactor 1 in which iron ore is continuously reduced to hot metal. Hot metal is continuously delivered to a refiner 2 in which the metal is continuously refined and alloyed. The refined and alloyed steel is then continuously passed through a degassing chamber 3 to a continuous caster 4. Continuously cast strip continuously moves through a slack takeup or looper 5 to a rolling mill 6 and then through a shear 7 to downcoilers 8.

In reactor 1, a plurality of ports 9 are provided in the upper section of the reactor. Jets 10 which are shown schematically in the drawing are positioned in the ports and directed downwardly and tangentially. Concentrated ore, coal and oxygen are blown through the jets into the reactor where they acquire a whirling motion due to the tangential orientation of the jets. A series of ports 11 and 12 are positioned below ports 9 and receive nozzles for introduction of secondary oxygen through ports 11 and 12. The nozzles have been omitted from the drawing for clarity. The walls of the furnace are equipped with pipes 14 for circulation of cooling water. Electrodes 75 project into the refiner and may be energized to provide electric arc heating. An uptake 15 leads to a gas cleaner for removal of particles generated in the furnace. A hearth 16 is provided in the lower section of the furnace. A slag notch 17 with a gate 18 is provided at one side. An accumulation of hot metal 19 and slag 20 are shown in the furnace. A passage 21 is shown leading to a hot metal downtake 22 which terminates in a dispersion cone 23 positioned in the top of refiner 2.

Refiner 2 is divided into four basic (may be more) sections—a jet chamber **2*a*, a thin layer processing (bubbling) section 2*b*, a thick layer processing section (settle bath) 2*c*, and an extraction chamber 2*d*. An oxygen pipe 24 leads to a hollow ring with small holes which surround cone 23. Oxygen is jetted into and commingled with hot metal coming downwardly through hot metal downtake 22 from the ring. Nozzles shown schematically at 25 are fitted in ports in the side of the jet chamber of refiner 2 for introduction of oxygen and limestone into the descending stream of hot metal. A hearth 26** is positioned in the bottom of the jet chamber of refiner 2. A bridge 27 extends across the top of the hearth leaving a restricted and controlled opening 28 between the hearth and the bottom of the bridge. Metal flowing through opening 28 in a shallow stream passes across a porous floor 29. Argon gas, or another inert gas, is supplied through pipe 30 under pressure and forced upwardly through the porous floor to the metal flowing across the floor.

A hearth 31 is located beyond porous floor 29 at a lower level. A sloping side 32 extends from floor 29 to the bottom of hearth 31. The line at which hot metal is maintained on the hearth is indicated at 33. Hearth 31 is within a settling chamber having side walls 32 and a roof 35. A slag notch 36 is provided in one of side walls 34 slightly above the hot metal line 33. A refractory baffle 37 is positioned in the settling chamber at the end opposite from porous floor 29. The baffle extends vertically from above the slag line to below the hot metal line. A space 38 is provided between the bottom of baffle 37 and hearth 31. A hot metal overflow port 39 is provided in the end wall of the settling chamber beyond baffle 37. Rows of ports 40, 41, 42, and 43 are provided in the roof 35 of the settling chamber. Lances 44 are positioned within the ports and are vertically movable so that their tips may be inserted into hot metal on the hearth or withdrawn from the hot metal. Various fluxing and alloying agents may be introduced through the ports and the lances. By way of illustration, apparatus is shown for introducing a powdered/granular material 45 contained in a hopper 46 through ports 40. A solid material such as rod 47 may be fed from a reel 48 by traction rolls 49. Other alloying or fluxing agents may be introduced in the same fashion through ports 42 and 43.

Metal from port 39 passes downwardly through a passage 50 and is sprayed through a degassing chamber 51. A vacuum is applied at port 52. Hot metal collects in the bottom of degassing chamber 51 to a level 53. The bottom of degassing chamber 51 terminates in an orifice 54 and a downwardly extending ultrasonic steel processor 55 which extends to a magneto-hydrodynamic feeder 56 of the continuous casting system. A tapering conduit 57 extends from the feeder of the continuous caster to a mold 58. A strip withdrawal mechanism comprising a roll 59 and an endless belt 60 takes strip from mold 58. Electromagnetic stirrers 61 are placed along conduit 57 and mold 58 to keep the metal stirred and to facilitate its delivery to the mold by electromagnetic action. The electromagnetic action promotes uniform cooling and crystallization through the volume of the metal. Powdered iron is injected into feeder 56 through an argon feeding pipe 62 into the steel which is being vigorously stirred just prior to entry into mold 58. The powdered iron intensifies and accelerates crystallization of the steel. The magneto-hydrodynamic feeder provides vigorous agitation of the metal and provides good conditions for formation of very fine grained equiaxial steel particles. The steel delivered to mold 58 from feeder 56 has a high percentage of solid fraction so that the rest of the solidification in the mold goes explosively resulting in fine equiaxially grained steel.

Newly cast strip leaves roll 59 and belt 60 and is trained by guide rolls 63 to a looping device 64. Strip leaving the looping device passes through four-high stands 65 and 66 of a rolling mill to a runout table 67. A shear 68 may be activated to cut the strip as required. Strip coming from the shear is directed by guide 69 to one of downcoilers 70 or 71. When a coil is fully wound on one coiler, the shear is activated to cut the moving strip. Guide 69 is moved to direct the lending edge of the strip to the other empty coiler so that the process is maintained in fully continuous operation. While strip is being wound on one coiler, a full coil is removed from the other coiler so that an empty coiler will always be available when needed.

In operation, the strip product is produced by injecting iron ore concentrate, finely reduced coal particles, and oxygen into the top of reactor 1 through ports 9. Nozzles 10 are tangentially inclined so that the injected materials form a swirling vortex. Once ignition has taken place, the reaction is self-sustaining. Additional oxygen is supplied through nozzles or lances in ports 11 and 12. A flash smelting process takes place in the vortex which reduces the iron ore to Wustite (FeO). Up to 90% of the total process energy required to manufacture the strip may be added at this stage. About 70% to 80% of the sulfur in the ore is eliminated as $SO_2$ during the flash smelting process. The iron oxide falls to the bottom of the reactor furnace where further refining takes place by electric arc heating from electrodes 75. A pool of metal is formed in the bottom of the reactor with a slag blanket on top. Slag is continuously tapped at 17 and hot iron which is high in carbon and silicon is continuously withdrawn through passage 21. The hot metal passes downwardly through downtake 22 and is dispersed in a conical spray or cascade by dispersion cone 23, and by oxygen which is jetted into the dispersed metal from oxygen pipe 24 and which reacts with the hot metal to reduce it to a more pure metallic product. The by-product is largely carbon monoxide which is withdrawn through port 76 and is used as a fuel gas to provide power for plant operation. Additional oxygen for reduction and powdered limestone for fluxing are introduced through nozzles 25 located in the side of refiner 2. Liquid steel collects on hearth 26 in a pool and flows continuously from the hearth in a shallow stream beneath bridge 27. The shallow stream of steel flows across porous floor 29. Argon or other inert gas is continuously forced upwardly through the pores and bubbles through the shallow stream of steel. The bubbling action of the argon acts to separate entrained slag and to bring it to the surface.

As the steel leaves floor 29, it passes into a deeper pool where settling and separation further take place. Slag rises to the top and is continuously removed through slag notch 36. Alloying agents may be added to the steel at this point through ports 40, 41, 42 and 43. Slag floating on the surface of the steel is held behind baffle 37. The refined and alloyed steel passes through opening 38 and out of the vessel through port 39. A continuous stream of steel passes downwardly into degassing chamber 3 which is maintained under vacuum with gases being removed at port 52. A controlled flow of degassed steel passes downwardly from chamber 3 through ultrasonic steel processor 55 into magneto-hydrodynamic feeder 56 of the continuous caster. Metal moves through tapering passage 57 to the mold where it is cast to a thickness of about 4 to 6 mm. The hot strip is removed from the mold by roll 59 and belt 60. The strip passes through a slack takeup or looper 64 of conventional design and then through mill stands 65 and 66. Reductions of the hot strip by 50% in each of mill stands 63 and 64 will produce 1 to 1.5 mm thick strip of good metallurgical quality and good mechanical properties. The strip is cut to length by shear 69 and wound in coils of appropriate size on down-coilers 70 and 71.

The strip is then ready to be sent to cold finishing facility

While I have described a present preferred embodiment of my invention, it is to be understood that I do not limit myself thereto and that my invention may be otherwise variously practiced within the scope of the following claims.

I claim:

1. The method of continuous steelmaking comprising:

(a) continuously blowing particulate iron ore, carbonaceous material and oxygen into a first zone, flash smelting it therein to FeO and reducing the FeO with said carbonaceous material to molten iron high in carbon and silicon, (b) continuously flowing said iron from said first zone into a second zone connected therewith as a dispersed spray and blowing it with oxygen to burn the carbon and silicon and convert the iron into steel, (c) continuously flowing said steel from said second zone into a third zone connected therewith and separating slag therefrom by gravity, (d) continuously flowing said steel from said third zone into a fourth zone connected therewith and continuously casting it therein, and (e) substantially excluding atmospheric air from said first, second, third and fourth zones.

2. The method of claim 1 in which said iron ore, carbonaceous material and oxygen are introduced into said first zone in the form of a downwardly swirling vortex.

3. The method of claim 1 in which said iron from said first zone is introduced into said second zone in the form of a conical descending spray and in which said oxygen is blown laterally into said spray.

4. The method of claim 1 including introducing alloying agents into said steel in said third zone.

5. The method of claim 1 including adding limestone to said steel in said second zone to form a slag.

6. The method of claim 1 including heating said iron in said first zone by electric arcs.

* * * * *

UNITED STATES PATENT AND TRADEMARK OFFICE

CERTIFICATE OF CORRECTION

PATENT NO. : 4,664,701

DATED : May 12, 1987

INVENTOR(S) : SEMYON E. ROYZMAN

It is certified that error appears in the above-identified patent and that said Letters Patent is hereby corrected as shown below:

Column 3, line 15, change "34" to --32--.

Column 5, line 2, insert --.-- at the end of the sentence.

Signed and Sealed this

First Day of September, 1987

*Attest:*

DONALD J. QUIGG

*Attesting Officer*

*Commissioner of Patents and Trademarks*